United States Patent [19]

Inman

[11] 4,387,492

[45] Jun. 14, 1983

[54] PLATED JACKET SOFT POINT BULLET

[75] Inventor: Darrel F. Inman, Lewiston, Id.

[73] Assignee: Omark Industries, Inc., Portland, Oreg.

[21] Appl. No.: 193,093

[22] Filed: Oct. 2, 1980

[51] Int. Cl.[3] ..... B21K 21/06

[52] U.S. Cl. ..... 29/1.23; 29/527.2; 72/47; 102/501; 102/514

[58] Field of Search ..... 29/1.21, 1.22, 1.23, 29/527.2, 1.2; 102/5.14–5.16, 501, 507–511; 72/47; 86/1 R, 10

[56] References Cited

U.S. PATENT DOCUMENTS

| | | | |
|---|---|---|---|
| 481,081 | 8/1892 | Tweedie . | |
| 1,447,478 | 3/1923 | Koshollek et al. . | |
| 2,336,143 | 12/1943 | Werme | 29/1.23 |
| 2,571,520 | 10/1951 | Barnes . | |
| 2,573,634 | 10/1951 | Whipple . | |
| 2,654,140 | 10/1953 | Gibbs . | |
| 3,069,748 | 12/1962 | Nosler . | |
| 3,165,809 | 1/1965 | Burns, Jr. et al. | 29/1.23 |
| 3,349,711 | 10/1967 | Darigo et al. . | |
| 3,431,612 | 3/1969 | Darigo et al. | 29/1.23 |

FOREIGN PATENT DOCUMENTS 22173 of 1891 United Kingdom .

*Primary Examiner*—Harold J. Tudor
*Attorney, Agent, or Firm*—John W. Stuart

[57] ABSTRACT

A method for making a plated soft nose bullet and the product resulting therefrom, wherein a core is formed of a deformable first metal and the entire core is then covered with a second metal by an electroplating process. The electroplated second metal is removed from the forward end of the core to expose a portion of the first metal. The plated core then is formed into its final shape in such a manner that a quantity of unplated core material is extruded from the remaining plated portions to form an unplated soft nose for the bullet.

6 Claims, 3 Drawing Figures

PLATED JACKET SOFT POINT BULLET

BACKGROUND AND SUMMARY OF THE INVENTION

This invention relates to a method for making a soft point or soft nose plated bullet and the product arising from such method.

It is known in the art that there are advantages to jacketed, or plated, soft point bullets. The jacket generally is formed of a material to provide a degree of lubrication for the bullet as it passes through the rifling of a barrel, thus to minimize galling, as may occur with a solid lead bullet. The jacket also aids in keeping the base metal of the bullet intact on impact while the point expands. Although the advantages of such bullets have been known for some time, past processes for making such bullets have not produced close tolerance uniformity in the jacketing material, nor were they able to produce an adequate bond between the core and the jacketing material, while providing a soft point of exposed core metal.

In the industry at the present time, it is common to produce a soft point, or soft nose, jacketed bullet by first producing a cup-shaped jacket of jacketing material, such as copper. Into this is inserted a quantity of core, or base, metal, such as lead. The core metal may be inserted either as a cylindrical wire section, or it may be poured therein in a molten state. Either way, there is only minimal adhesion provided between the core and jacketing material, and thus, there is a tendency for separation to occur in use.

It is recognized that U.S. Pat. No. 3,431,612 to Darigo et al discloses a base metal core which has a jacket electroplated thereto. However, there is no suggestion therein of forming a bullet having an exposed protruding soft nose of base metal.

A primary object of the present invention is to provide a novel plated jacket soft point bullet which overcomes many of the disadvantages of prior art devices.

Another object is to provide a novel method for producing such a bullet which overcomes the disadvantages of the prior art as set out above, and produces a useful soft point jacketed bullet.

A further object is to provide a novel method for producing a soft nose jacketed bullet in which there is maximum adhesion between the core and plating material to minimize separation during use, while still providing an exposed protruding soft metal point.

Yet another object is to provide a novel soft nose jacketed bullet in which the jacketing material is applied in a uniform selected thickness and density.

A still further object of the present invention is to provide a novel method for forming a soft nose jacketed bullet in such a manner that jacketing material required is reduced to a minimum to conserve valuable materials, yet provides sufficient jacketing and adhesion characteristics that satisfactory operational characteristics are achieved.

THE DRAWINGS

The manner in which the foregoing and other objects and advantages of the invention are accomplished will become more clearly apparent from the accompanying specification and claims, considered with the drawings wherein:

FIG. 1 is an enlarged perspective view of a bullet constructed according to an embodiment of the invention;

FIGS. 2A, B, C, D, and E illustrate progressive steps in a method for producing a bullet according to the invention; and FIG. 3 is a flow diagram illustrating the five stages of the method illustrated in FIGS. 2A–E.

DETAILED DESCRIPTION OF A PREFERRED EMBODIMENT

Figure 1:
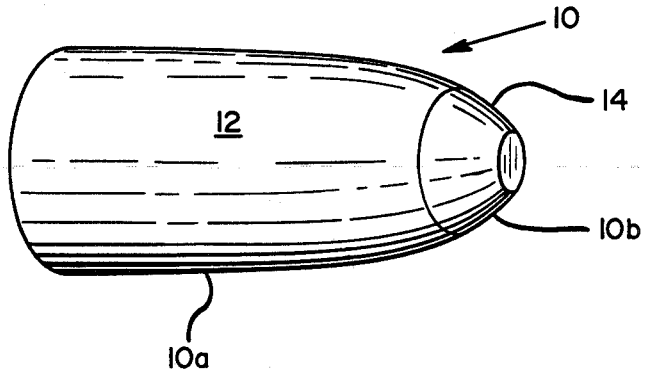

Describing the invention and referring first to FIG. 1, a 10 is indicated generally a bullet produced by a preferred embodiment of the invention. The bullet has a generally cylindrical main body portion 10*a* and a nose, or point, portion 10*b* which converges on progressing to the right in FIG. 1. The end of the bullet at the left of FIG. 1 is referred to herein as the rear end, and the portion at the right end of FIG. 1 is referred to as the forward, point, or nose end of the bullet. The major portion of the body of the bullet is plated with a jacketing material 12, such as copper. The core, or base, metal 14, which may be lead, projects from the forward end thereof to provide a soft nose for the bullet which will give desired expansion upon impact.

Figure 2:
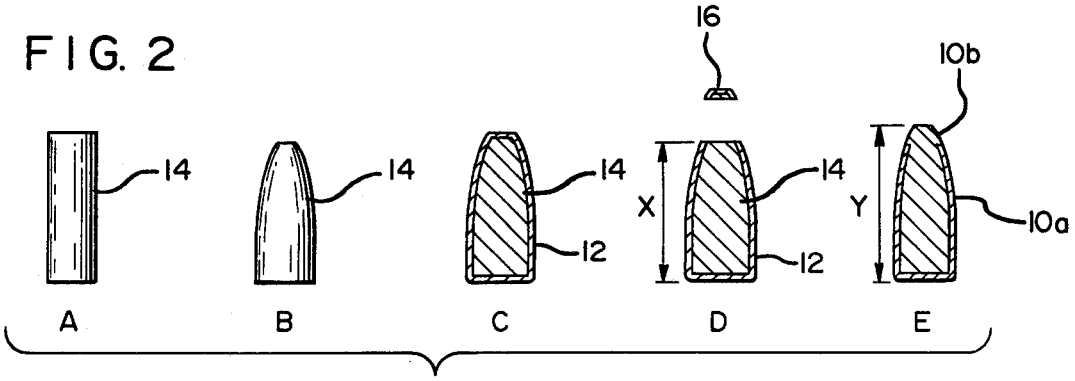
Figure 3:
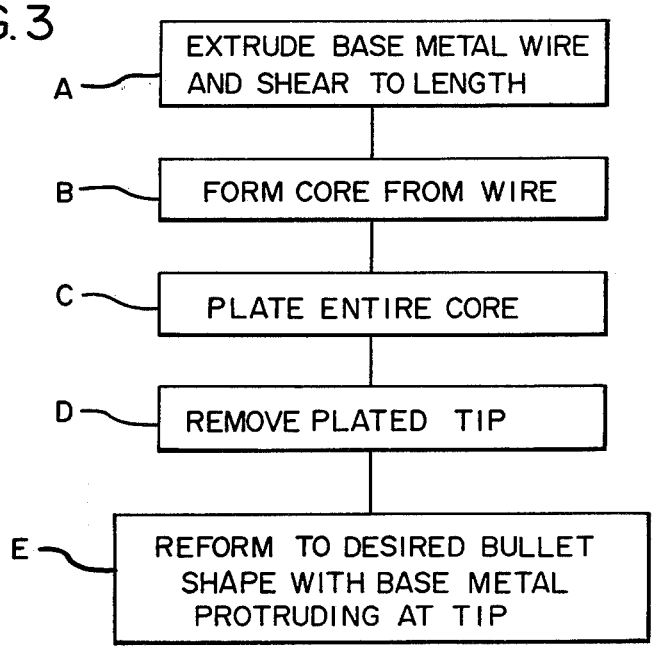

The steps for producing such a bullet under a preferred embodiment of the invention are illustrated in FIGS. 2A–E and 3A–E. Referring to FIGS. 2A, 3A, initially a preselected quantity of a deformable base, or first, metal is extruded into a cylindrical core form and sheared to a preselected length. The core has opposed forward and rear ends.

Next (FIGS. 2B, 3B) this first metal is formed, as by a conventional swaging operation, into a core 14 generally of the configuration of the bullet to be produced. Although it is formed generally to the shape of the desired bullet to be formed, it may have a greater diameter and/or a shorter length than the final bullet.

In the next step (FIGS. 2C, 3C), the entire core is electroplated with a copper jacket 12, as by a barrel or tumbling plating operation. The barrel plating method for applying such a jacket is known, and thus will not be described in detail here. However, it should be recognized that such a process provides excellent adhesion between the core and plating material and can be controlled to produce desired thickness and density of plating material.

Progressing to the steps illustrated in FIGS. 2D, 3D, after plating, the forward end, or tip, of the plated core is sheared off, producing an excess portion 16. Portion 16 will include all of the electroplated metal covering the extreme forward end of the plated core, and may include a forward portion of the core also. The primary purpose of this step is to expose a forwardly directed portion of the core, or first metal. The scrap material 16 may be reprocessed and reclaimed for further use. At this step the plated core is reduced to a length "X."

The next step in the process is illustrated at FIGS. 2E, 3E. In this step the plated core is reformed, as by a conventional swaging operation, to the desired final shape of the bullet. During this step, a radially inwardly directed force is applied to side portions of the plated core and a quantity of the unplated core material is extruded forwardly from remaining plated portions into a die of appropriate shape to form an unplated nose or point 10*b* on the bullet. Here the bullet is formed to its final shape with a length "Y" which is greater than "X."

As a specific example of this process, in forming a 0.357–140 grs. bullet, the original lead core formed in steps FIGS. 2A–B, 3A–B is 140 grs. During the plating process of FIGS. 2C, 3C, 10 grs. of plating material are applied to make the combination 150 grs. In the steps of FIGS. 2D, 3D, approximately 10 grs. of recoverable scrap 16 is sheared from the tip to produce a bullet with a finished weight of 140 grs. This 140 grs. total weight is then reformed to the desired shape illustrated in FIGS. 1 and 2E with the protruding lead core material defining the soft nose, or point, portion of the bullet.

A bullet thus manufactured has a core of deformable first metal on which a second metal is electroplated for maximum adhesion therebetween. The jacketing, or second metal, covers the rear end of the bullet and major portions of the side walls, or portions, of the core. A nose portion of the core material protrudes from the forward end of the jacket and is exposed to form the soft point which will give desired expansion characteristics during use.

Although a preferred embodiment of the invention has been described herein, it is recognized that variations and modifications are possible without departing from the spirit of the invention.

I claim:

1. A method for manufacturing a plated soft nose bullet comprising the steps of providing a selected quantity of a deformable first metal capable of being electroplated, forming said first metal into a core generally of the size and shape of the desired finished bullet, said core having opposed forward and rear ends, electroplating said core with a second metal to a pre-selected thickness, removing the electroplated second metal from the forward end of said core to expose a portion of said first metal, and forming said plated core to its desired final shape and size in such a manner that a quantity of unplated first metal is extruded forwardly from remaining plated portions to form an unplated forward portion for said bullet.

2. The method of claim 1 wherein at least a portion of said core initially is formed with a greater diameter than the desired final shape of the bullet, and upon forming to its desired length and diameter said unplated portion is extruded forwardly to form said unplated forward portion.

3. The method of claims 1 or 2 wherein said electroplated second metal is removed from the forward end of said core by being sheared therefrom with a quantity of said first metal.

4. The method of claim 1 wherein said first metal is lead or lead alloy and the second metal is copper or copper alloy.

5. The method of claim 1 wherein said second metal added during said electroplating is in a range of from 4–20% by weight of said first metal in the initially-formed core, and upon removing the electroplated second metal from the forward end of the core first and second metal in the range of 4–20% of the weight of the core is removed.

6. A method for manufacturing a plated soft nose bullet comprising the steps of providing a selected quantity of a deformable first metal capable of being electroplated, forming said first metal into a generally cylindrical core having opposed forward and rear ends, electroplating said core with a second metal to a pre-selected thickness, removing the electroplated second metal from the forward end of said core to expose a portion of said first metal, and forming said plated core to its desired final shape and size in such a manner that a quantity of unplated first metal is extruded forwardly from remaining plated portions to form an unplated forward portion for said bullet.

* * * * *